United States Patent [19]

Knight et al.

[11] 4,392,652

[45] Jul. 12, 1983

[54] TARGET COMPRISING A RESILIENT MATERIAL COATED WITH THERMOLUMINESCENT MATERIAL

[75] Inventors: Lindsay C. Knight, Albury, Australia; Robert A. Cottis, Stockport, England

[73] Assignee: Australasian Training Aids Pty. Ltd., Albury, Australia

[21] Appl. No.: 187,819

[22] Filed: Sep. 16, 1980

Related U.S. Application Data

[63] Continuation of Ser. No. 43,486, May 29, 1979, abandoned.

[30] Foreign Application Priority Data

May 26, 1978 [GB] United Kingdom ..... 23483/78

[51] Int. Cl.[3] ..... F41J 5/00; F41J 9/14

[52] U.S. Cl. ..... 273/358; 273/378; 273/408; 273/DIG. 24; 273/DIG. 28

[58] Field of Search ..... 273/378, 408, DIG. 24, 273/358, DIG. 28

[56] References Cited

U.S. PATENT DOCUMENTS

| | | | |
|---|---|---|---|
| 1,091,116 | 3/1914 | Buell | 273/378 |
| 2,826,677 | 3/1958 | Jobanek | 273/DIG. 24 X |
| 3,370,852 | 2/1968 | Kandel | 273/378 |

FOREIGN PATENT DOCUMENTS

| | | | |
|---|---|---|---|
| 618555 | 4/1936 | Fed. Rep. of Germany | 273/408 |

*Primary Examiner*—Anton O. Oechsle

*Attorney, Agent, or Firm*—Schwartz, Jeffery, Schwaab, Mack, Blumenthal & Koch

[57] ABSTRACT

A target material comprises a rubber sheet coated with a thermoluminescent material. When a bullet penetrates the target, as a result of the temperature rise the thermoluminescent material thermoluminesces indicating where the bullet went. A range is disclosed in which images of targets are projected onto the target material.

4 Claims, 3 Drawing Figures

TARGET COMPRISING A RESILIENT MATERIAL COATED WITH THERMOLUMINESCENT MATERIAL

This is a continuation of application Ser. No. 043,486, filed May 29, 1979, abandoned.

BACKGROUND OF THE INVENTION

The present invention relates to a target material and also relates to a target apparatus and a range utilising said target material, the range being suitable for use in the training of military personnel or other personnel who are to be trained in the art of marksmanship. Over recent years many attempts have been made to provide a realistic training for troops and other such military personnel in the art of marksmanship. Whilst for many years troops and such like personnel have been trained in the art of marksmanship by firing at static targets, it has been found desirable to train troops and similar personnel with as much realism as possible. The present invention seeks to provide a target material, and a target apparatus and a range which facilitate the training of troops in the art of marksmanship in a realistic manner.

SUMMARY OF THE INVENTION

According to the broadest aspect of this invention there is provided a target material comprising a support member adapted to be impinged by bullets, and a coating of a thermoluminescent material on said support member.

Preferably the support member is formed of a material which is not destroyed when a bullet passes therethrough, and thus the support member many be formed of a plastics material or a resilient material.

A preferred target material is latex rubber.

The coating of thermoluminescent material provided on the support is preferably adapted so that thermoluminescent material will luminesce when the temperature thereof is raised by a bullet passing through the support material. When a bullet is fired from a weapon and passes through the air at a high speed, the temperature of the bullet is high, and when the bullet passes through a target the portion of the target immediately adjacent the hole formed by the bullet is raised to an elevated temperature partly due to the high temperature of the bullet, partly due to kinetic energy which is transferred from the bullet to the target end partly due to the fact that when a material such as rubber is bent or flexed (as is the case when a bullet penetrates a latex rubber support) the temperature of the material rises. The thermoluminescent material used on a target in accordance with the invention is preferably selected so that the temperature to which the termoluminescent material is raised when a bullet passes through the target is such that the thermoluminescent material will luminesce. It has been found that in many cases the temperature of the support material may rise by approximately 15° C. if the support material is latex rubber, when a bullet passes therethrough.

According to another aspect of this invention there is provided a target comprising a support member provided with a thermoluminescent material thereon. Conveniently the support member is formed of latex rubber.

According to yet a further aspect of this invention there is provided a range comprising a target having a support member with thermoluminescent material thereon, there being means for projecting a visible image onto said target. Conveniently the target may extend over one or more walls of a closed room.

Preferably means are provided for "killing" the thermoluminescence of the thermoluminescent material, such means comprising means for applying an electric or magnetic field to the thermoluminescent material, or means for irradiating the thermoluminescent material with light of a predetermined wavelength to "kill" the thermoluminescence. Alternatively, means may be provided for cooling the appropriate region of the target.

According to another aspect of the invention there is provided a range apparatus comprising projector means adapted to project an image representing a background and a moving target, and means for detecting the position of a real or simulated bullet fired at said projected image and means for displaying, on the projected image, the point at which the real or simulated bullet impinged upon the prejected image.

Preferably means are provided for projecting a background image and a separate target image which is superimposed upon the background image, these images being projected onto an appropriate screen or the like. Conveniently the projection means may comprise slides or cinematographic films, the slides or cinematographic films being projected through a projector which has, as its light source, a high powered cathode ray tube. Conveniently two separate films may be provided, one having a background image and one having a target image, the target image, in the target image film being on a blank or black background, the two images being projected with light from two scanning cathode ray tubes, the scanning images being synchronised, means being provided to blank the tube scanning the background image film in regions of the background image where the target is located.

Conveniently a third scanning cathode ray tube may be provided to provide superimposed images indicative of the position of a bullet or simulated bullet.

Conveniently the range equipment may include means to detect live rounds fired from weapons towards the target, said bullet detection means being any appropriate bullet detection means. Alternatively, if the range equipment is to utilise simulated fire a simulated weapon may be utilised which comprises a photocell and lens system, the range being such that a very small region of the screen will be focussed upon the photocell, the photocell thus providing an output pulse when the spot of light scanning the screen passes across the region of the screen upon which the simulated weapon is focussed. Information concerning the precise instant at which the scanning spot reaches this region of the target is indicative of the region of the target, thus permitting the point of aim of the simulated weapon to be measured. The point of aim of the simulated weapon may easily be measured when the trigger thereof is pulled.

BRIEF DESCRIPTION OF THE DRAWINGS

In order that the invention may be more readily understood, and so that further features thereof may be appreciated, the invention will now be described by way of example with reference to the accompanying drawings, in which.

DESCRIPTION OF PREFERRED EMBODIMENTS

Figure 1:
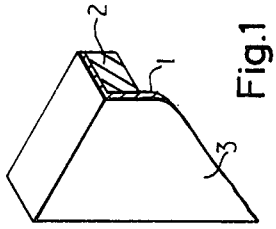
FIG. 1 is a perspective view, partly cut away, of part of a target in accordance with the invention.

Referring to FIG. 1 a target comprises a support member formed of sheet 1 of latex rubber material or other such material. The support member may be mounted in a rigid frame 2 or the like and one surface 3 thereof is coated with a thermoluminescent material as sold by Kodak Ltd.

The thermoluminescent material is selected so that when the temperature thereof rises the thermoluminescent material will emit light which is visible light.

Figure 2:
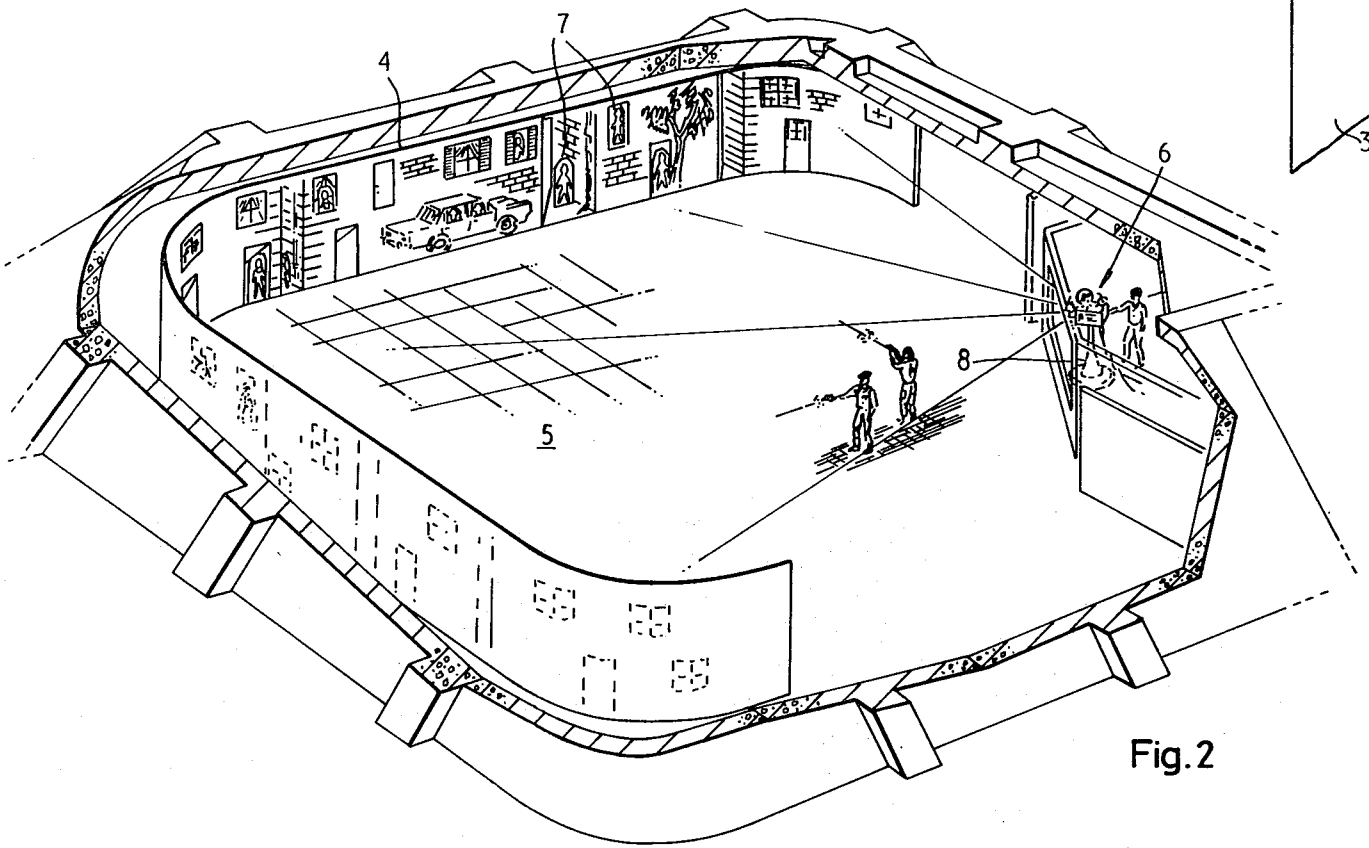
FIG. 2 is a perspective view of a range using targets as shown in FIG. 1.

Referring to FIG. 2 a plurality of targets or one large target formed as indicated above may be assembled together to form a screen 4 covering two or more walls of a substantially closed room 5, and projection means 6 are provided to project images 7 onto the screen 4.

In one embodiment of the invention, the projector 6 will be adapted to project onto the targets a moving film, the film depicting various military situations and showing various targets 7 which trainee marksman can be instructed to fire at. The targets may for example weave and dodge, as skilled military personnel will weave and dodge when under fire and thus realistic training can be given to trainee marksmen 8. Means may be provided to stop the projector 6 when a trainee marksman fires at the target so that the image of the weaving or dodging person will "freeze". Such means may comprise a device responsive to the sound of weapon being fired adapted to stop the drive motor of the projector, or may comprise a switch connected to the weapon. When the bullet fired by the trainee marksman impinges on the screen 4 heat will be transferred from the bullet to the target, in view of the relatively high temperature of the bullet, and also the temperature of the target will rise due to the kinetic energy transferred to the target by the bullet passing therethrough and also due to the flexing of the target as the bullet passes therethrough. Thus the region of the target surrounding the aperture formed by the bullet as it passes through the target will be raised to an elevated temperature, and the thermoluminescent material will emit light of a visible wavelength. Thus the trainee marksman and any instructor will be able to see the precise position at which the bullet passes through the target relative to the visual image projected thereon by the projector, and thus the trainee marksman and the instructor may be able to assess whether the shot constituted a "hit" or "miss". Subsequently the projector 6 can again be started, and a further film showing another military situation will be presented to the trainee marksman 8. Of course the nature of the films to be projected can be selected in dependence upon the nature of the skills that are to be taught to the trainee marksman.

It may be desired to "kill" the thermoluminescence once the results of a particular shot have been studied, and to enable the thermoluminescence to be "killed" means may be provided for appying a relatively high magnetic or electric field to the thermoluminescent material to prevent further thermoluminescence. Alternatively, means may be provided for irradiating the thermoluminescent material with light of a predetermined wavelength which will cause the thermoluminescence to cease, or alternatively means may be provided for cooling the particular area of the target that is thermoluminescing. Thus it is envisaged that a hand-held device may be provided which will provide the necessary magnetic or electric field, or light of a predetermined wavelength to any predetermined area of the target merely by directing the device at the appropriate area of the target, or by holding the device adjacent the appropriate area of the target. Alternatively the device, when held adjacent the appropriate area of the target may cool that area of the target. Thus, for example, the device may be adapted to spray a coolant at an appropriate area of the target.

It will be appreciated that many alternative methods may be utilised to "kill" the thermoluminescence the particular method selected depending upon the nature of the thermoluminescent material. It will be appreciated that many modifications may be made to the particularly described embodiments of the invention without departing from the scope of the present invention.

Figure 3:
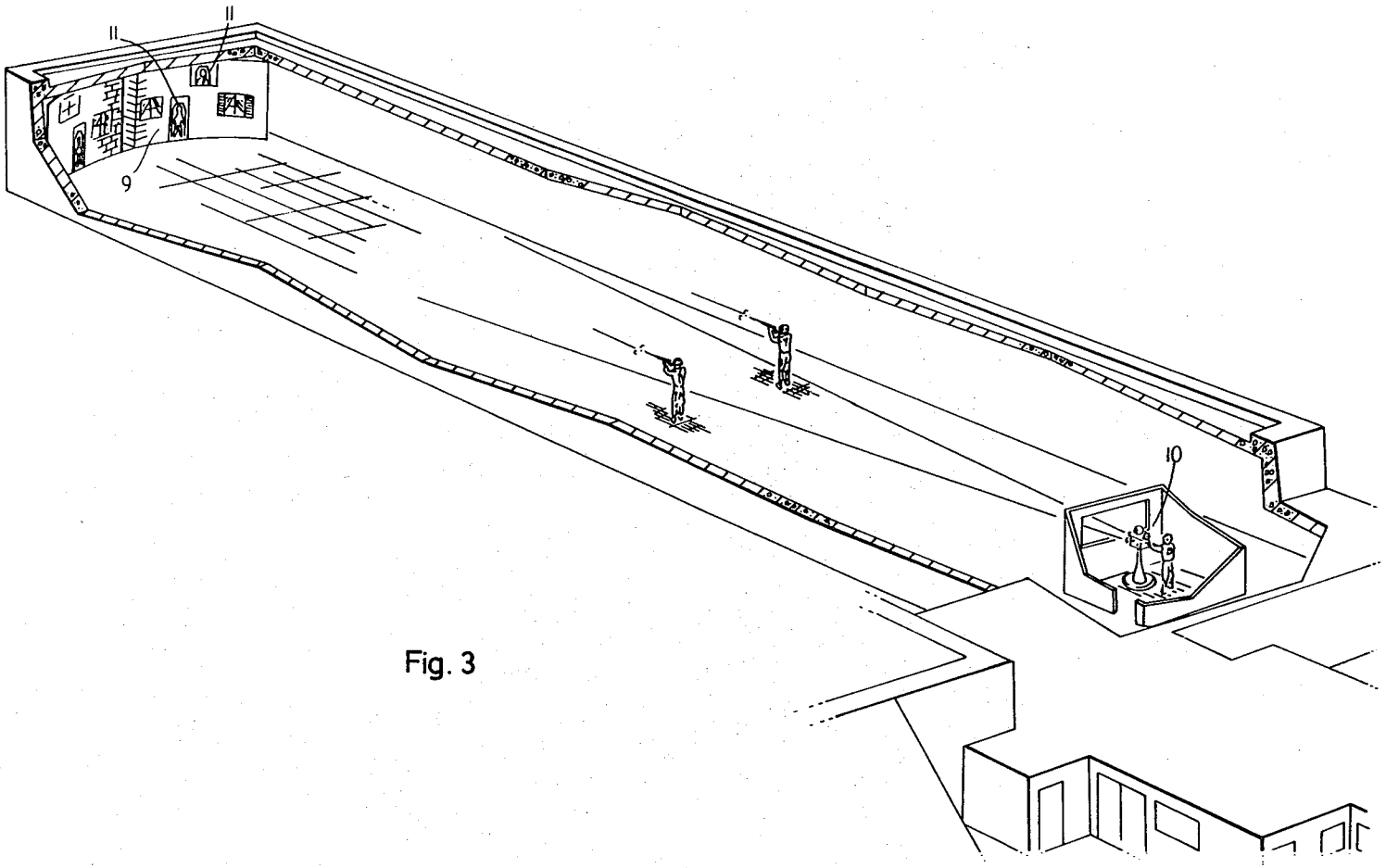
FIG. 3 is a perspective view of another range in accordance with the invention.

Another embodiment of the invention shown in FIG. 3 comprises a target range comprising a screen 9 of any suitable material and a projecting 10 adapted to project images onto the screen. The projector 10 is adapted to project images from two films onto the screen, the first film comprising a cinematographic film representative of a background. However, the background may be intended to be stationary in which case a slide or transparency may be utilised. The image of the background transparency or film is projected onto the screen with light from a high powered cathode ray tube, such as a cathode ray tube of the type that is utilised for Schmidt projection television. The resultant image projected onto the screen consists of a modulated spot of light scanning the screen at a high speed which gives the impression of a steady coloured picture, substantially, the same as a conventional television picture. However, it is to be appreciated that the scanning spot or light passes through the emulsion present on the transparency or the appropriate frame of the cinematographic film.

A second film is provided which is in the form of a cinematographic film and this film comprises an image of a moving target, such as an image representative of an enemy soldier or an enemy tank or a criminal or the like. All areas of this second cinematographic film which do not bear portions of the target image are black. This second cinematographic film is projected onto the target with light from a second scanning high intensity cathode ray tube, this second ray tube being synchronised with the first cathode ray tube. Means are provided within the projector 10 to determine when the second cathode ray tube is scanning the target image rather than the black background and when the second cathode ray tube is scanning the target image rather than the black background the first cathode ray tube is blanked. Thus the two cathode ray tubes combine to project onto the screen a composite image comprising a background and a moving target.

A third cathode ray tube is provided within the projector 10 to indicate where a real or simulated bullet fired at the image 11 projected onto the screen 9 actually impinges upon the screen. This third tube will be controlled by a computer and may project an image through a filter to give different colours in different parts of the screens. Thus for example the third tube may be used to project red shot position markers and white identifying numerals at the top of the screen.

Various methods may be utilised to detect where real or simulated shots impinge on the targets. If live rounds are utilised it is to be appreciated that the target may be coated with the infra red emitting material described above. Alternatively many of the readily available devices for detecting the position of a bullet may be utilised. Information concerning the position of the bullet relative to the target is fed to a computer and the computer may then be utilised to control the third cathode ray tube to project an appropriate image onto the target.

If it is preferred to use simulated weapons, then it is possible that a simulated weapon may be utilised which is provided with a photocell and a lens system mounted on the weapon with the photocell. The photocell is activated when the trigger of the weapon is pulled so as to detect the precise instant at which the scanning spot scanning the screen passes across the particular region of the screen upon which the photocell is focussed. This instant time is, of course, definitely indicative of the precise region of the screen at which the weapon is pointing, and thus this information can be fed to the computer and appropriate indicative markings may be projected onto the screen by the third cathode ray tube.

The foregoing description of the invention has been presented for purposes of illustration and description. It is not intended to be exhaustive or to limit the invention to the precise forms disclosed, and obviously many modifications and variations are possible in light of the above teaching. These embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A target comprising a support member adapted to be penetrated by projectiles, said support member being formed from a resilient material which is not destroyed when a projectile passes therethrough and which locally increases in temperature as it is penetrated by said projectile, a coating of thermoluminescent material on said support member which is operable to luminesce in the area adjacent the position at which the projectile passes through the target.

2. A target according to claim 1 wherein said resilient material is latex rubber.

3. A target as defined in claim 1, further comprising means for projecting a visible image onto said target.

4. A target according to claim 3 wherein the target extends over at least one wall of a closed room.

* * * * *